US008242966B2

(12) United States Patent
Liu

(10) Patent No.: US 8,242,966 B2
(45) Date of Patent: Aug. 14, 2012

(54) ANTENNA ARRAY

(75) Inventor: Ming-Yen Liu, Taipei (TW)

(73) Assignee: ASUSTek Computer Inc., Taipei (TW)

( * ) Notice: Subject to any disclaimer, the term of this patent is extended or adjusted under 35 U.S.C. 154(b) by 551 days.

(21) Appl. No.: 12/408,655

(22) Filed: Mar. 20, 2009

(65) Prior Publication Data

US 2009/0284430 A1 Nov. 19, 2009

(30) Foreign Application Priority Data

May 16, 2008 (TW) ..... 97118074 A

(51) Int. Cl.
*H01Q 21/26* (2006.01)

(52) U.S. Cl. ..... 343/797; 343/795

(58) Field of Classification Search ..... 343/700 MS, 343/795, 797, 805, 810, 821, 848, 852, 860
See application file for complete search history.

(56) References Cited

U.S. PATENT DOCUMENTS

| | | | | |
|---|---|---|---|---|
| 4,746,925 | A * | 5/1988 | Toriyama | 343/713 |
| 5,285,212 | A * | 2/1994 | McNiece | 343/795 |
| 6,067,053 | A * | 5/2000 | Runyon et al. | 343/797 |
| 6,069,590 | A * | 5/2000 | Thompson et al. | 343/795 |
| 6,072,439 | A * | 6/2000 | Ippolito et al. | 343/797 |
| 6,140,972 | A * | 10/2000 | Johnston et al. | 343/725 |
| 6,211,840 | B1 * | 4/2001 | Wood et al. | 343/793 |
| 7,173,572 | B2 * | 2/2007 | Teillet et al. | 343/810 |
| 7,639,198 | B2 * | 12/2009 | Timofeev et al. | 343/805 |
| 7,688,271 | B2 * | 3/2010 | Cao et al. | 343/797 |
| 7,724,201 | B2 * | 5/2010 | Nysen et al. | 343/821 |
| 2006/0273865 | A1 | 12/2006 | Timofeev et al. | |
| 2007/0241983 | A1 | 10/2007 | Cao et al. | |
| 2010/0164831 | A1 * | 7/2010 | Rentz et al. | 343/852 |

FOREIGN PATENT DOCUMENTS

CN 2505992 Y 8/2002

* cited by examiner

*Primary Examiner* — Jacob Y Choi
*Assistant Examiner* — Kyana R McCain

(57) ABSTRACT

An antenna array is provided. The antenna comprises a first antenna unit, a second antenna unit, a third antenna unit and a fourth antenna unit. The first antenna unit, the second antenna unit, the third antenna unit and the fourth antenna unit have L-shaped cross-sections. The second antenna unit is close to the first antenna unit. The third antenna unit is close to the second antenna unit. The fourth antenna unit is close to the third antenna unit and the first antenna unit. The fourth antenna unit is opposite to the second antenna unit. The third antenna unit is opposite to the first antenna unit.

7 Claims, 7 Drawing Sheets

ANTENNA ARRAY

CROSS REFERENCE TO RELATED APPLICATIONS

This application claims priority of Taiwan Patent Application No. 097118074, filed on May 16, 2008, the entirety of which is incorporated by reference herein.

BACKGROUND OF THE INVENTION

1. Field of the Invention

The present invention relates to an antenna array, and in particular relates to an omnidirectional antenna array.

2. Description of the Related Art

Conventionally, an omni directional dipole antenna is utilized for transmitting signals from different directions. However, the dipole antenna decreases gain value and transmission distance. To improve gain value of the dipole antenna, the dimension of the dipole antenna is increased. For example, a dipole antenna having a gain value of 11 dBi for transmitting a signal with a frequency of 0.8 GHz has a length of more than 300 cm.

US Pub. 2006/0273865 and U.S. Pat. No. 7,173,572 disclose microstrip antennas for transmitting signals from different directions. However, the conventional micro strip antenna is assembled with a holder or a supporting shelf. The cost and size of the conventional micro strip antennas are therefore relatively high.

BRIEF SUMMARY OF THE INVENTION

A detailed description is given in the following embodiments with reference to the accompanying drawings.

An antenna array is provided. The antenna comprises a first antenna unit, a second antenna unit, a third antenna unit and a fourth antenna unit. The first antenna unit, the second antenna unit, the third antenna unit and the fourth antenna unit have L-shaped cross-sections. The second antenna unit is close to the first antenna unit. The third antenna unit is close to the second antenna unit. The fourth antenna unit is close to the third antenna unit and the first antenna unit. The fourth antenna unit is opposite to the second antenna unit. The third antenna unit is opposite to the first antenna unit.

The antenna array of the embodiment provides improved omnidirectional signal transmission with reduced antenna dimension.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is the best-contemplated mode of carrying out the invention. This description is made for illustrating the general principles of the invention and should not be taken in a limiting sense. The scope of the invention is best determined by reference to the appended claims.

Figure 1:
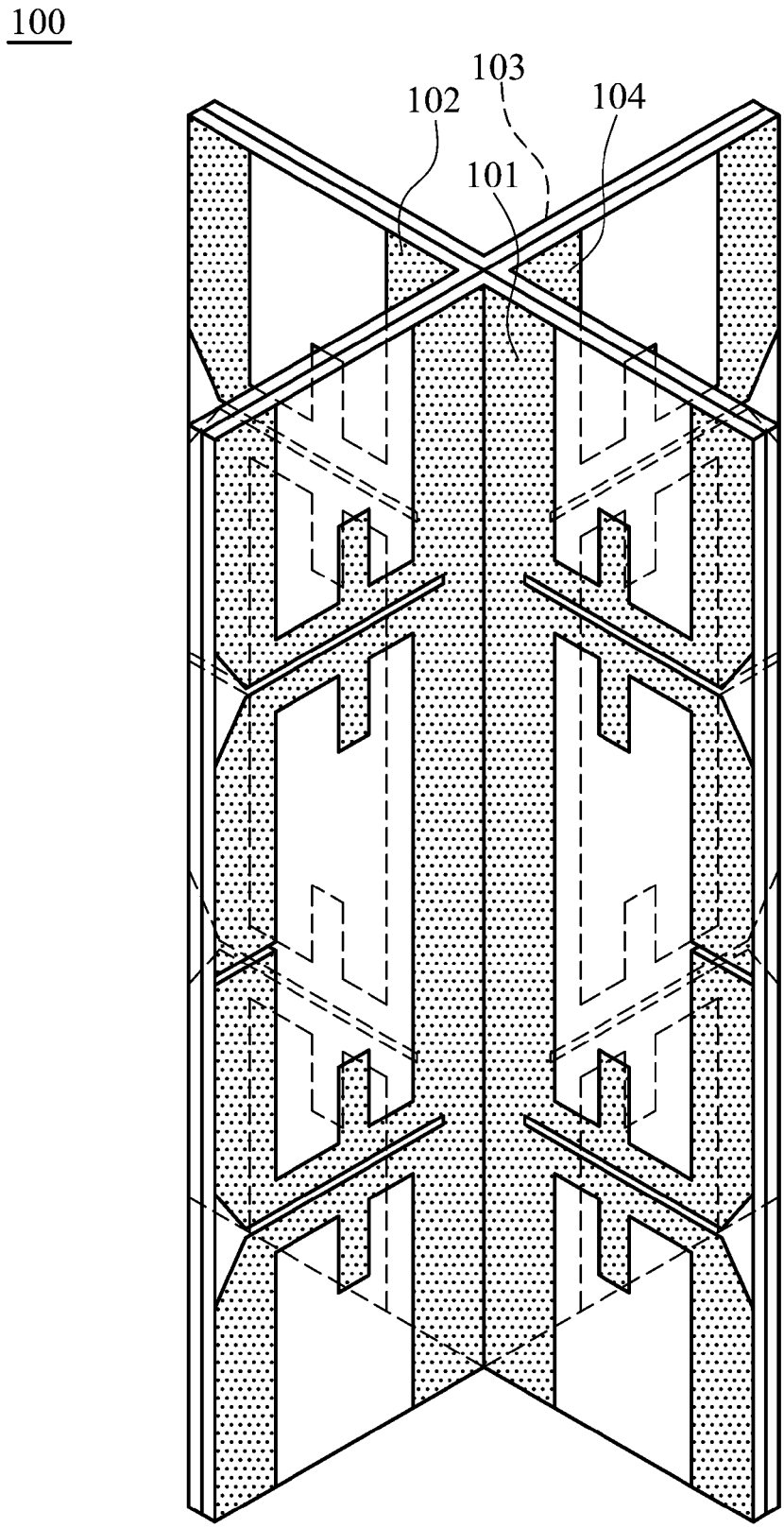
FIG. 1 shows an antenna array of an embodiment of the invention.

FIG. 1 shows an antenna array 100 of an embodiment of the invention, comprising a first antenna unit 101, a second antenna unit 102, a third antenna unit 103 and a fourth antenna unit 104. The first antenna unit 101, the second antenna unit 102, the third antenna unit 103 and the fourth antenna unit 104 have L-shaped cross-sections. The second antenna unit 102 is close to the first antenna unit 101. The third antenna unit 103 is close to the second antenna unit 102. The fourth antenna unit 104 is close to the third antenna unit 103 and the first antenna unit 101. The fourth antenna unit 104 is opposite to the second antenna unit 102. The third antenna unit 103 is opposite to the first antenna unit 101.

The detailed structure of the first antenna unit 101 is described hereafter. The detailed structures of the second antenna unit 102, the third antenna unit 103 and the fourth antenna unit 104 are similar to that of the first antenna unit 101, and the description of the second antenna unit 102, the third antenna unit 103 and the fourth antenna unit 104 are thus omitted to simplify the description.

Figure 2:
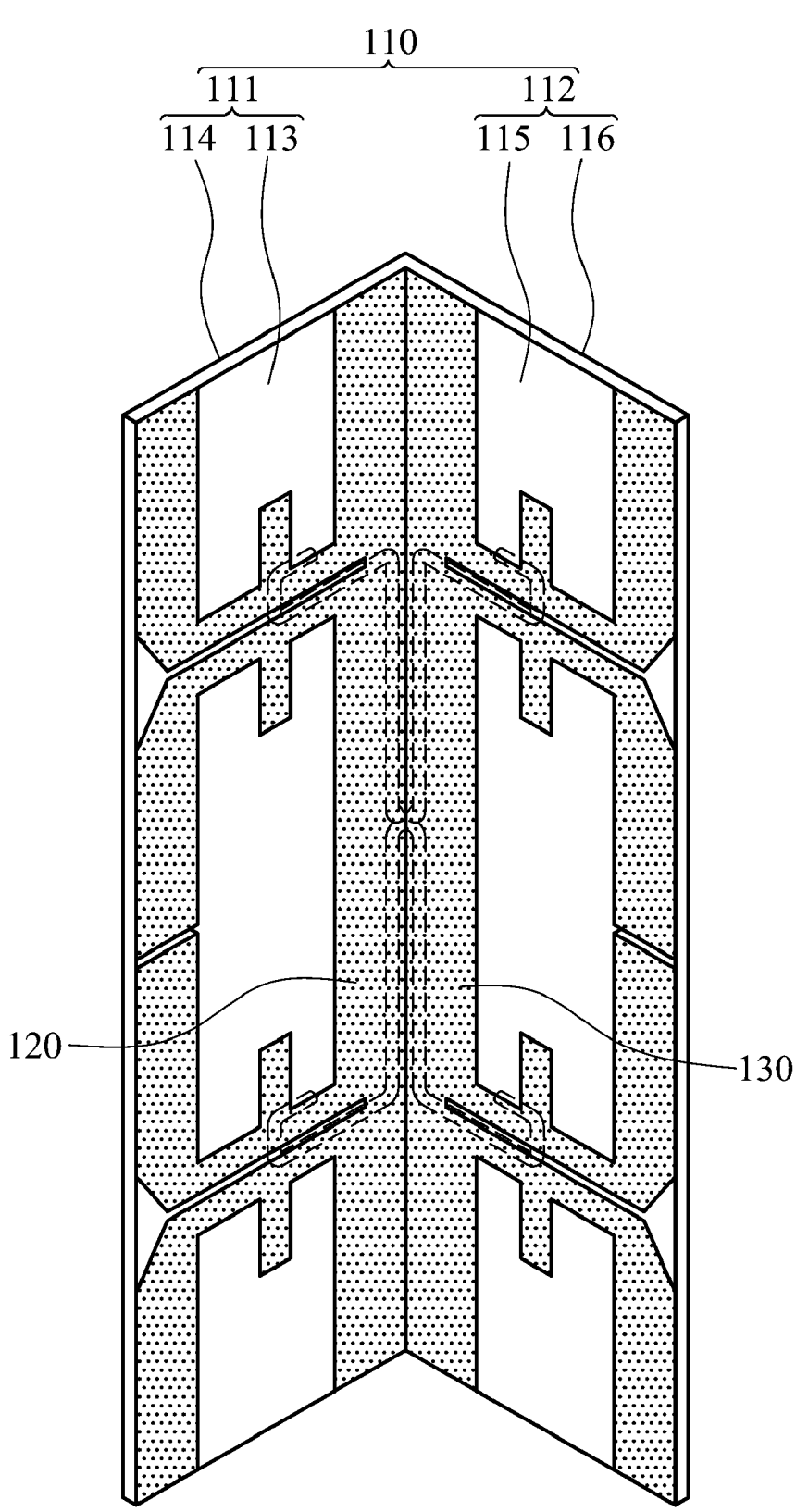
FIG. 2 shows a structure of a first antenna unit of the antenna array.

FIG. 2 shows the structure of the first antenna unit 101, which comprises an L-shaped substrate 110, a first antenna 120 and a second antenna 130. The L-shaped substrate 110 comprises a first area 111 and a second area 112. The first area 111 is perpendicular to the second area 112. The first area 111 comprises a first upper surface 113 and a first lower surface 114. The second area 112 comprises a second upper surface 115 and a second lower surface 116. The first antenna 120 is disposed on the first area 111. The second antenna 130 is disposed on the second area 112.

Figure 3A:
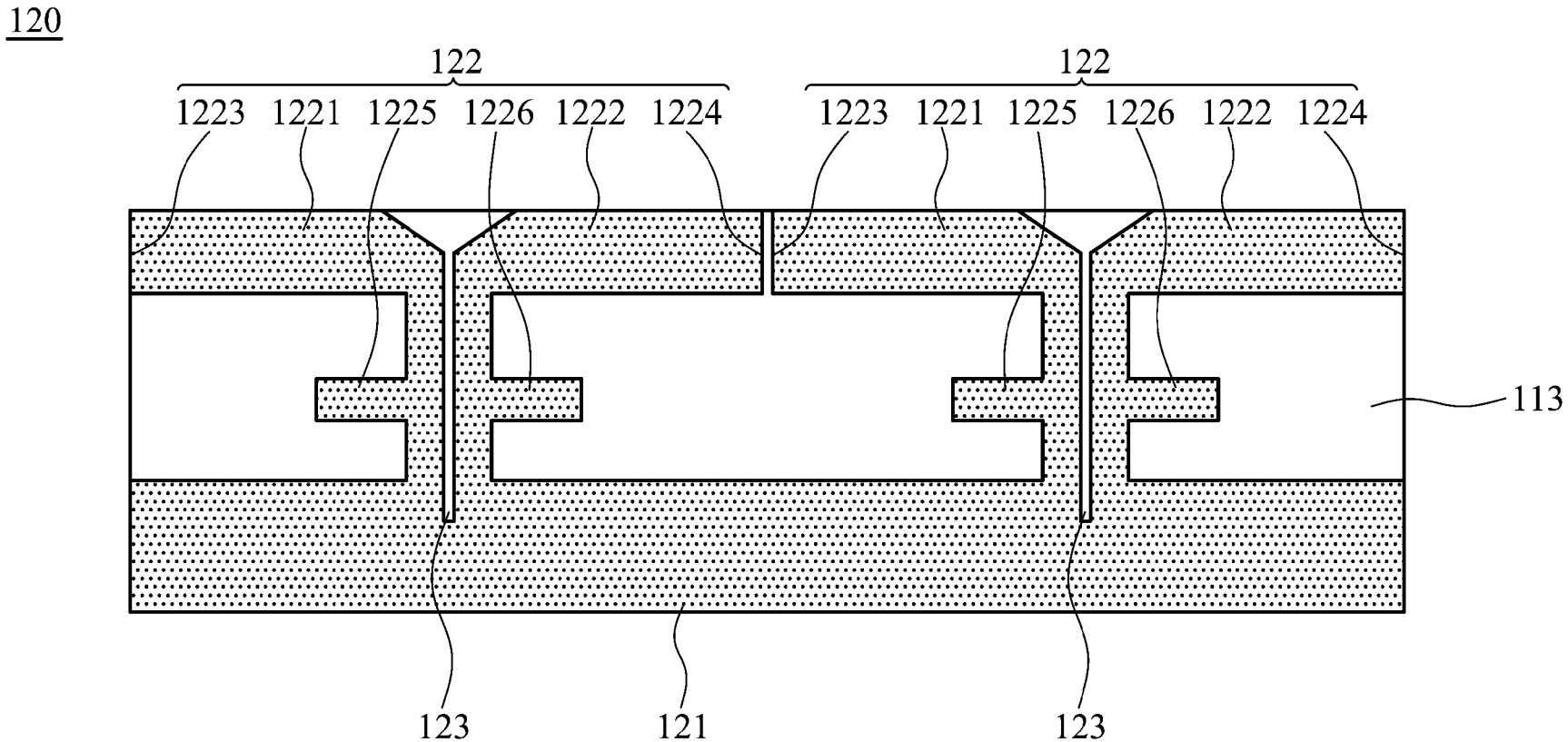
FIG. 3*a* shows a detailed structure of a first antenna on a first upper surface.
Figure 3B:
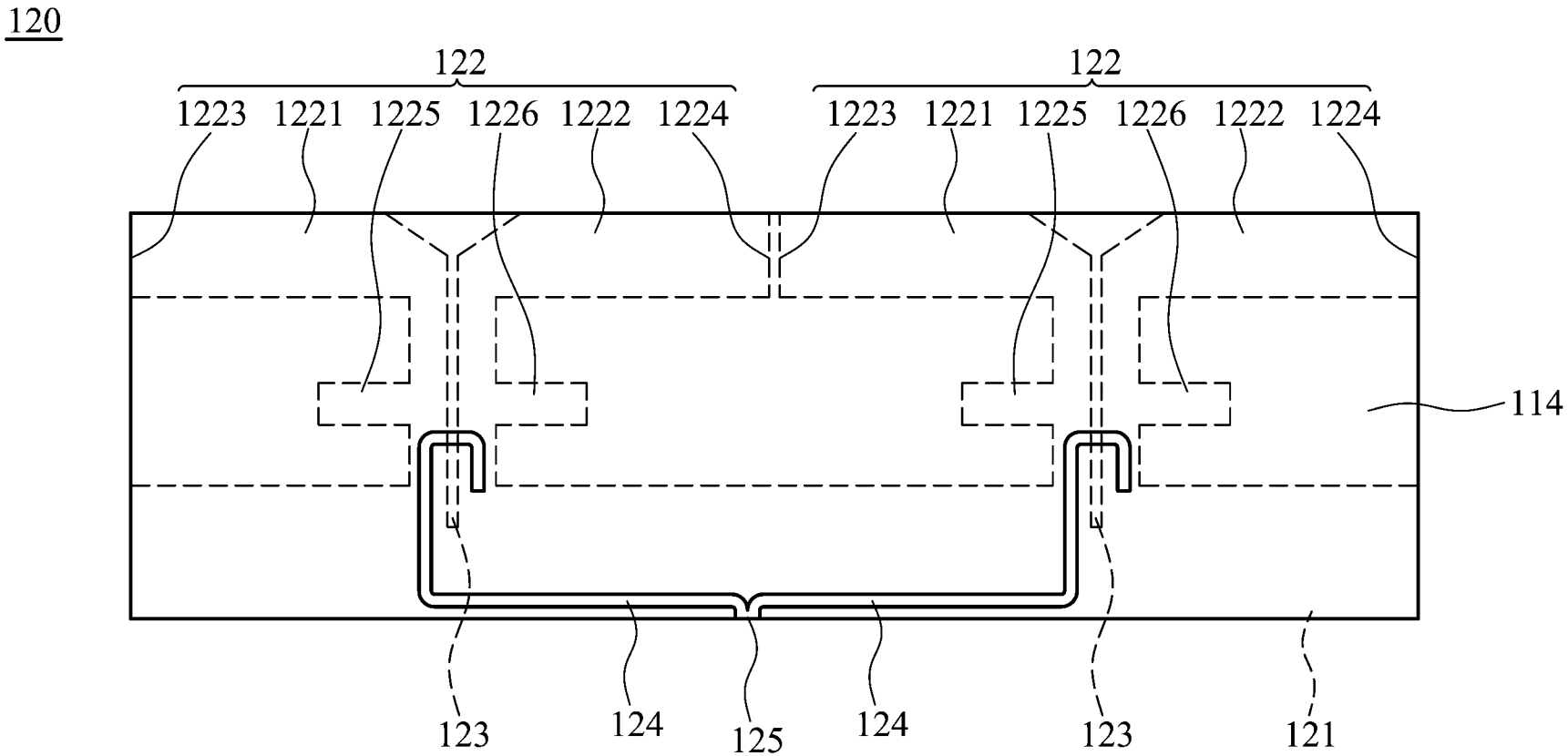
FIG. 3*b* shows a detailed structure of the first antenna on a first lower surface.

FIGS. 3*a* and 3*b* show a detailed structure of the first antenna 120. The first antenna 120 comprises a first ground portion 121, two first radiation portions 122, two first feed conductors 124, a first signal line (not shown) and a first ground line (not shown). The first ground portion 121 is connected to the first radiation portions 122. The first ground portion 121 and the first radiation portions 122 are disposed on the first upper surface 113. The first feed conductors 124 are disposed on the first lower surface 114. The first feed conductors 124 correspond to the first radiation portions 122. The first ground line (not shown) is electrically connected to the first ground portion 121. The first signal line (not shown) is electrically connected to the first feed conductor 124.

With reference to FIG. 3*a*, each first radiation portion 122 comprises a first L-shaped radiation element 1221 and a second L-shaped radiation element 1222. The first L-shaped radiation element 1221 comprises a first free end 1223. The second L-shaped radiation element 1222 comprises a second free end 1224. The first free end 1223 and the second free end 1224 extend in opposite directions. The first L-shaped radiation element 1221 further comprises a matching element 1225, and the second L-shaped radiation element 1222 further comprises a matching element 1226 to improve signal transmission.

A slot 123 is formed between the first L-shaped radiation element 1221 and the second L-shaped radiation element 1222. With reference to FIG. 3*b*, the first feed conductor 124 is corresponding to the first L-shaped radiation element 1221, the second L-shaped radiation element 1222 and the slot 123. The first feed conductor 124 couples the first radiation portion 122.

In the embodiment of the invention, the first antenna has two first radiation portions. However, the invention is not limited thereto. In a modified embodiment of the invention, the first antenna can have single first radiation portion or more than three first radiation portions.

Similar to the first antenna, the second antenna comprises a second ground portion, two second radiation portions, two second feed conductors, a second signal line (not shown) and a second ground line (not shown). The second ground portion is connected to the second radiation portions. The second ground portion and the second radiation portions are disposed on the second upper surface. The second feed conductors are disposed on the second lower surface. The second feed conductors correspond to the second radiation portions. The second ground line is electrically connected to the second ground portion. The second signal line is electrically connected to the second feed conductor. The structure of the second antenna is the same to that of the first antenna. The description of the second antenna is thus omitted to simplify the description.

In the embodiment of the invention, the first ground portion and the second ground portion are welded together. In a modified embodiment, the first ground portion and the second ground portion are integrally formed. In another modified embodiment, the first ground portion and the second ground portion are separated from each other.

The antenna units of the embodiment of the invention utilize the end-fire dipole antenna for transmitting signals. In the antenna array 100 of the embodiment, the first antenna unit 101, the second antenna unit 102, the third antenna unit 103 and the fourth antenna unit 104 face four different directions, and thus the antenna array 100 can transmit signals from different directions.

Figure 4:
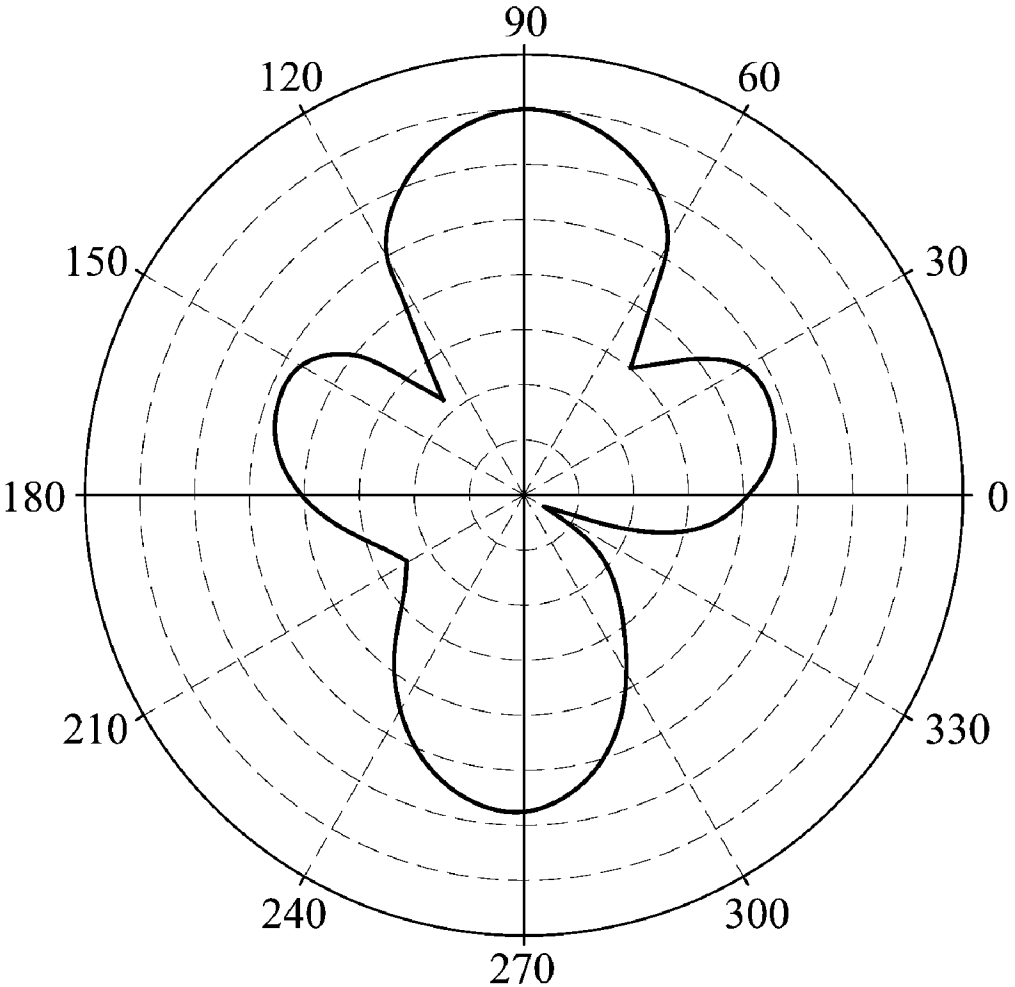
FIG. 4 shows an E-plane divergence field of the antenna array of the embodiment of the invention.
Figure 5:
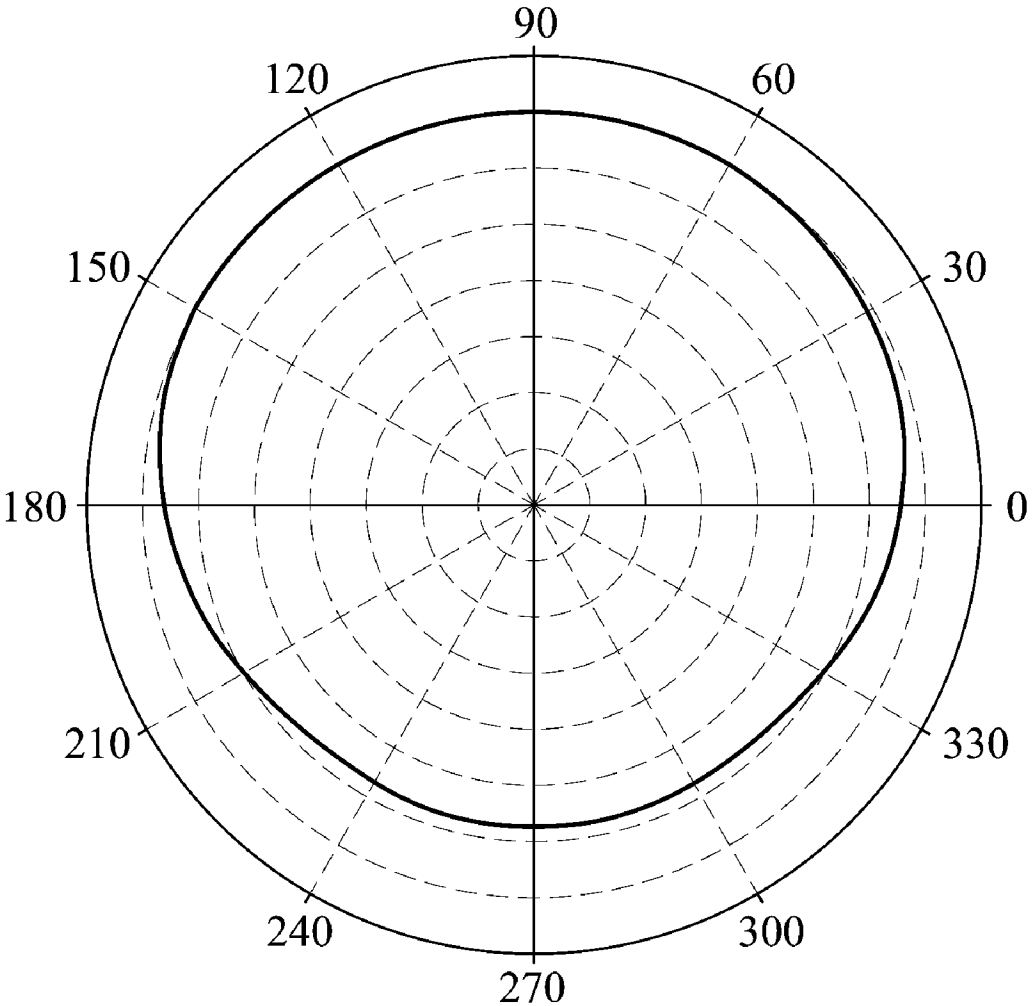
FIG. 5 shows an H-plane divergence field of the antenna array of the embodiment of the invention.
Figure 6:
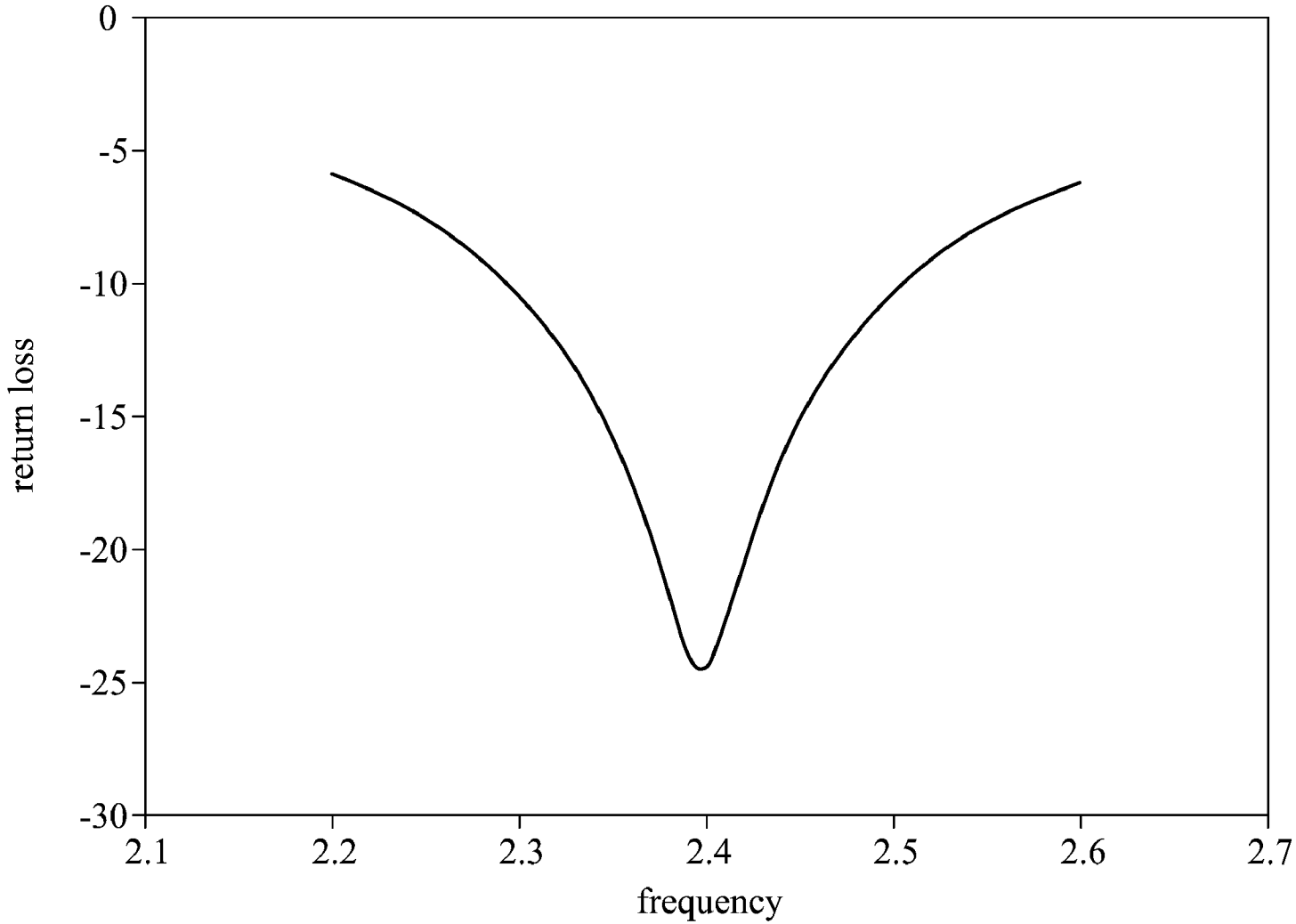
FIG. 6 shows input return loss (S11) of the antenna array of the embodiment of the invention.

With reference to FIGS. 4, 5 and 6, FIG. 4 shows an E-plane divergence field of the antenna array of the embodiment of the invention. FIG. 5 shows an H-plane divergence field of the antenna array of the embodiment of the invention. FIG. 6 shows input return loss (S11) of the antenna array of the embodiment of the invention. As shown in FIGS. 4, 5 and 6, the antenna array of the embodiment provides improved omnidirectional signal transmission with reduced antenna dimension.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna array, comprising:

a first antenna unit, comprising:

a L-shaped substrate, comprising a first area and a second area, which are perpendicular to each other, the first area comprising a first upper surface and a first lower surface, and the second area comprising a second upper surface and a second lower surface;

a first antenna, comprising a first ground portion, a first radiation portion and a first feed conductor, wherein the first ground portion is connected to the first radiation portion, the first ground portion and the first radiation portion are disposed on the first upper surface, the first feed conductor is disposed on the first lower surface, and the first feed conductor is corresponding to the first radiation portion; and a second antenna, comprising a second ground portion, a second radiation portion and a second feed conductor, wherein the second ground portion is connected to the second radiation portion, the second ground portion and the second radiation portion are disposed on the second upper surface, the second feed conductor is disposed on the second lower surface, and the second feed conductor is corresponding to the second radiation portion, wherein the first radiation portion comprises a first L-shaped radiation element and a second L-shaped radiation element, the first L-shaped radiation element comprises a first free end, the second L-shaped radiation element comprises a second free end, and the first free end and the second free end are extended in opposite directions.

2. The antenna array as claimed in claim 1, wherein a slot is formed between the first L-shaped radiation element and the second L-shaped radiation element, and the first feed conductor is corresponding to the first L-shaped radiation element, the second L-shaped radiation element and the slot.

3. The antenna array as claimed in claim 1, wherein the first feed conductor couples the first radiation portion.

4. The antenna array as claimed in claim 1, further comprising a second antenna unit, wherein the second antenna unit is close to the first antenna unit.

5. The antenna array as claimed in claim 4, further comprising a third antenna unit, wherein the third antenna unit is close to the second antenna unit.

6. The antenna array as claimed in claim 5, further comprising a fourth antenna unit, wherein the fourth antenna unit is close to the third antenna unit and the first antenna unit, and is opposite to the second antenna unit.

7. The antenna array as claimed in claim 1, wherein the first ground portion is connected to the second ground portion.

* * * * *